US012564775B2

(12) United States Patent
Kuo

(10) Patent No.: US 12,564,775 B2
(45) Date of Patent: Mar. 3, 2026

(54) FOUR-WHEEL PITCHING MACHINE

(71) Applicant: Chou-Chien Kuo, Dongguan City (CN)

(72) Inventor: Chou-Chien Kuo, Dongguan City (CN)

( * ) Notice: Subject to any disclaimer, the term of this patent is extended or adjusted under 35 U.S.C. 154(b) by 158 days.

(21) Appl. No.: 18/418,352

(22) Filed: Jan. 22, 2024

(65) Prior Publication Data

US 2025/0235771 A1 Jul. 24, 2025

(51) Int. Cl.
*A63B 69/40* (2006.01)

(52) U.S. Cl.
CPC ..... *A63B 69/406* (2013.01); *A63B 69/40* (2013.01)

(58) Field of Classification Search
CPC . A63B 69/406; A63B 69/40; A63B 2069/402; A63B 2071/025
USPC ..... 124/78
See application file for complete search history.

(56) References Cited

U.S. PATENT DOCUMENTS 3,724,437 A * 4/1973 Halstead ..... A63B 69/406 124/78
3,777,732 A * 12/1973 Holloway ..... A63B 69/406 124/78
4,712,534 A * 12/1987 Nozato ..... A63B 69/406 124/78
5,125,653 A * 6/1992 Kovacs ..... A63B 69/406 124/78
5,464,208 A * 11/1995 Pierce ..... A63B 69/406 124/78
5,649,523 A * 7/1997 Scott ..... A63B 69/406 124/78
5,865,161 A * 2/1999 Bruce ..... A63B 69/406 124/78
6,182,649 B1 * 2/2001 Battersby ..... G09B 19/0038 124/78
6,440,013 B1 * 8/2002 Brown ..... A63B 69/406 124/78
9,180,355 B1 * 11/2015 Boehner ..... A63B 69/0002
9,220,337 B1 * 12/2015 Wenzel ..... A47B 13/023
2005/0092311 A1 * 5/2005 Johndreau ..... A63B 69/406 124/78
2005/0166905 A1 * 8/2005 Boehner ..... A63B 69/406 124/78
2013/0333679 A1 * 12/2013 Kroll ..... A63B 69/40 124/7
2014/0261363 A1 * 9/2014 Lu ..... F41B 4/00 124/78

* cited by examiner

*Primary Examiner* — John E Simms, Jr.
(74) *Attorney, Agent, or Firm* — Leong C. Lei

(57) ABSTRACT

A four-wheel pitching machine includes a base and a pitching mechanism. The pitching mechanism includes a frame, a housing, four rotary wheels, four drive units, and a control unit. The housing has a ball outlet, a ball inlet, and a chamber. The four rotary wheels are disposed on an upper side, a lower side, a left side and a right side of the chamber, respectively. A ball passageway is defined among the four rotary wheels. The four rotary wheels are driven by the four drive units, respectively. The control unit has four control knobs for controlling the four drive units, respectively.

5 Claims, 4 Drawing Sheets

FOUR-WHEEL PITCHING MACHINE

BACKGROUND OF THE INVENTION

1. Field of the Invention

The present invention relates to a pitching machine, and more particularly to a four-wheel pitching machine that is used for pitching balls such as baseball, tennis, softball and other balls.

2. Description of the Prior Art

As people's living standards continue to improve, more and more people recognize the importance of having a good physical fitness, and they gradually strengthen a variety of sports exercise. This has thus led to the expanding market for products related to ball sports. Most players will use a ball pitching machine to help improve their efficiency. With a ball pitching machine, there is less need for a training partner to pick balls and one can train solo while effectively increasing competitive skill level and achieving the objective of training. In general, a conventional pitching machine includes two rotary wheels to rotate as pitching power, having the advantages of high speed, easy control, and economical benefits. However, its disadvantage is that it has a single style of pitching balls, which does not fully meet the needs of some professional practitioners.

In these days, a three-wheel pitching machine is developed on the market. The three-wheel pitching machine includes three rotary wheels arranged in a Y-shaped configuration. Three drive units are connected to the three rotary wheels, respectively. The three-wheel pitching machine can pitch balls at different angles by adjusting the rotational speeds of the three rotary wheels according to the needs. However, its structural design is poorly. The three rotary wheels are all exposed. When the three rotary wheels collide with other objects, it is easy to shift the position of the three rotary wheels, resulting in that the three rotary wheels cannot be used normally. Or, in the process of pitching balls, the user' finger may be in contact with the rotary wheels accidentally, causing safety hazards. The safety performance is poor, and the scope of application is small.

Therefore, there is a need to develop a new technical solution to solve the above problems.

SUMMARY OF THE INVENTION

In view of the shortcomings of the prior art, the primary object of the present invention is to provide a four-wheel pitching machine having hidden rotary wheels that won't be in direct contact with other objects, thereby avoiding injuries when the user comes into contact with the rotary wheels accidentally. The pitching machine has excellent safety performance. In particular, the arrangement of four rotary wheels and four drive units makes balls more powerful when the pitching machine pitches balls. Four control knobs control the four rotary wheels for the pitching mechanism to throw a breaking ball. The pitching machine has good usability and a wide range of applications.

In order to achieve the above object, the present invention adopts the following technical solution:

A four-wheel pitching machine comprises a base and a pitching mechanism on the base. The pitching mechanism includes a frame, a housing, four rotary wheels, four drive units, and a control unit. The frame is disposed on the base. The housing is disposed on the frame. The housing has a ball outlet, a ball inlet, and a chamber. The four rotary wheels are disposed on an upper side, a lower side, a left side and a right side of the chamber, respectively. A ball passageway is defined among the four rotary wheels. The ball outlet and the ball inlet are located on front and rear sides of the ball passageway. The four drive units are disposed on the housing. The four rotary wheels are driven by the four drive units, respectively. The control unit is disposed on the frame and located on one side of the housing. The control unit has four control knobs. The four drive units are respectively connected to the four control knobs of the control unit to adjust rotational speeds of the four rotary wheels, so that the pitching machine is able to throw a breaking ball.

Compared with the prior art, the present invention has obvious advantages and beneficial effects. Specifically, it can be seen from the above technical solution that the rotary wheels are disposed inside the housing in a hidden manner, so that the rotary wheels won't be in direct contact with other objects, thereby avoiding injuries when the user comes into contact with the rotary wheels accidentally. The pitching machine has excellent safety performance and improves the stability of the rotary wheels when in use. In particular, the arrangement of four rotary wheels and four drive units makes balls more powerful when the pitching machine pitches balls. The four control knobs control the four rotary wheels to squeeze and rub the ball at different rotational speeds for the pitching mechanism to throw a breaking ball. The pitching machine can simulate the throw of a ball by a pitcher, thus meeting the practice needs of the practitioners, with good usability and a wide range of applications.

Further, the housing can be rotated forward and backward on the frame, so that the trainer can control the pitching mechanism to pitch balls in multiple directions, thus achieving the training of one machine to many people and improving the practice effect of the practitioner. Besides, the handle is configured for the trainer to control the housing to rotate forward and backward.

Further, the frame can be rotated left and right on the base, so that the trainer can control the pitching mechanism to pitch balls left and right, thereby improving the practice effect of the practitioner. The operating lever is beneficial for the trainer to control and adjust the angle of the frame, further improving the practice effect of the practitioner. The positioning assembly is configured to secure and position the operating lever on the base.

Further, the pitching machine further includes an adjustment part for the trainer to adjust the frame on the base left and right slightly, without the need for large angle adjustment, thus improving the practice experience of the practitioner. Further, the pitching machine further includes a locking assembly configured to lock the front and rear ends of a locking plate using a first locking rod and a second locking rod to lock the housing on the frame, so that the product can be stored and moved easily by the trainer or the practitioner. The pitching machine further includes a protective net configured to prevent the ball from hitting the housing directly when the practitioner strikes the ball, thus ensuring the stability of the rotary wheels and the drive unit on the housing when in use. The practicality is strong.

Further, the pitching machine further includes first support poles, a second support pole, and wheels. The pitching machine can be tilted forward for the wheels to be in contact with the ground, and the first support poles can be removed, and then the second support pole is used to move the pitching machine. This is beneficial to fold and store the pitching machine. The pitching machine further has placement positions configured to store the first support poles on the base after the first support poles are removed.

DETAILED DESCRIPTION OF THE PREFERRED EMBODIMENTS

Embodiments of the present invention will now be described, by way of example only, with reference to the accompanying drawings.

Figure 1:
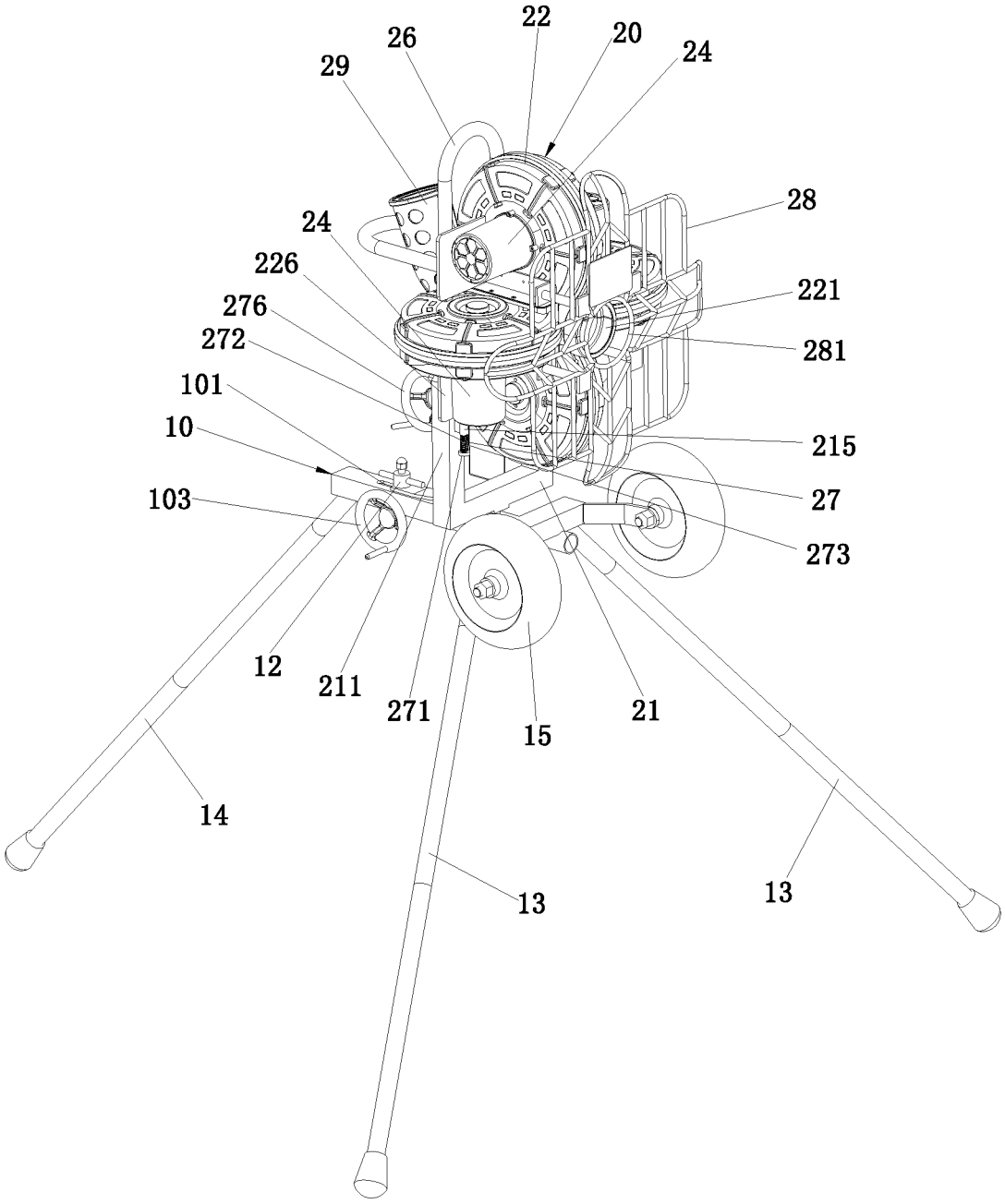
FIG. 1 is a first perspective view in accordance with a preferred embodiment of the present invention.
Figure 2:
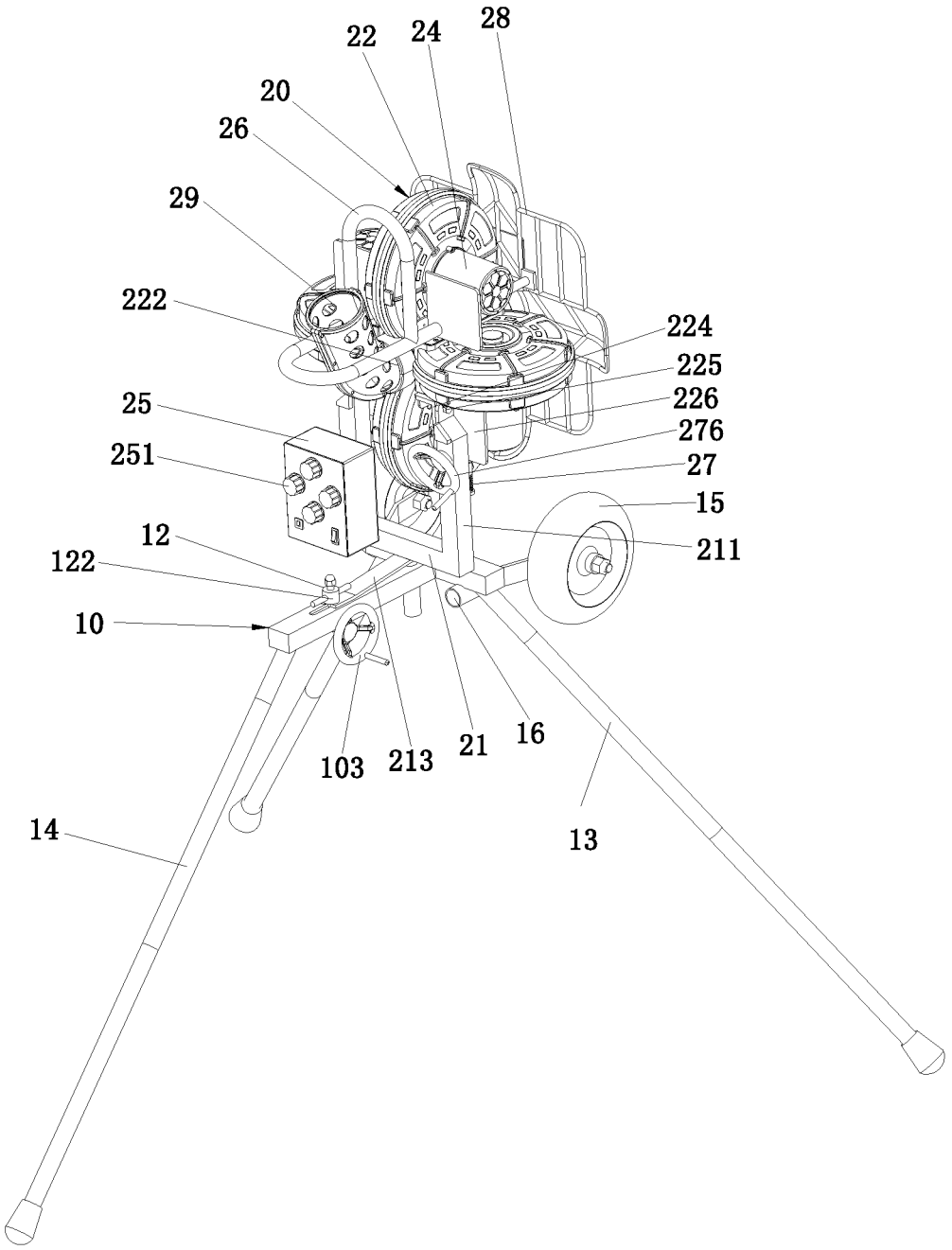
FIG. 2 is a second perspective view in accordance with the preferred embodiment of the present invention.
Figure 3:
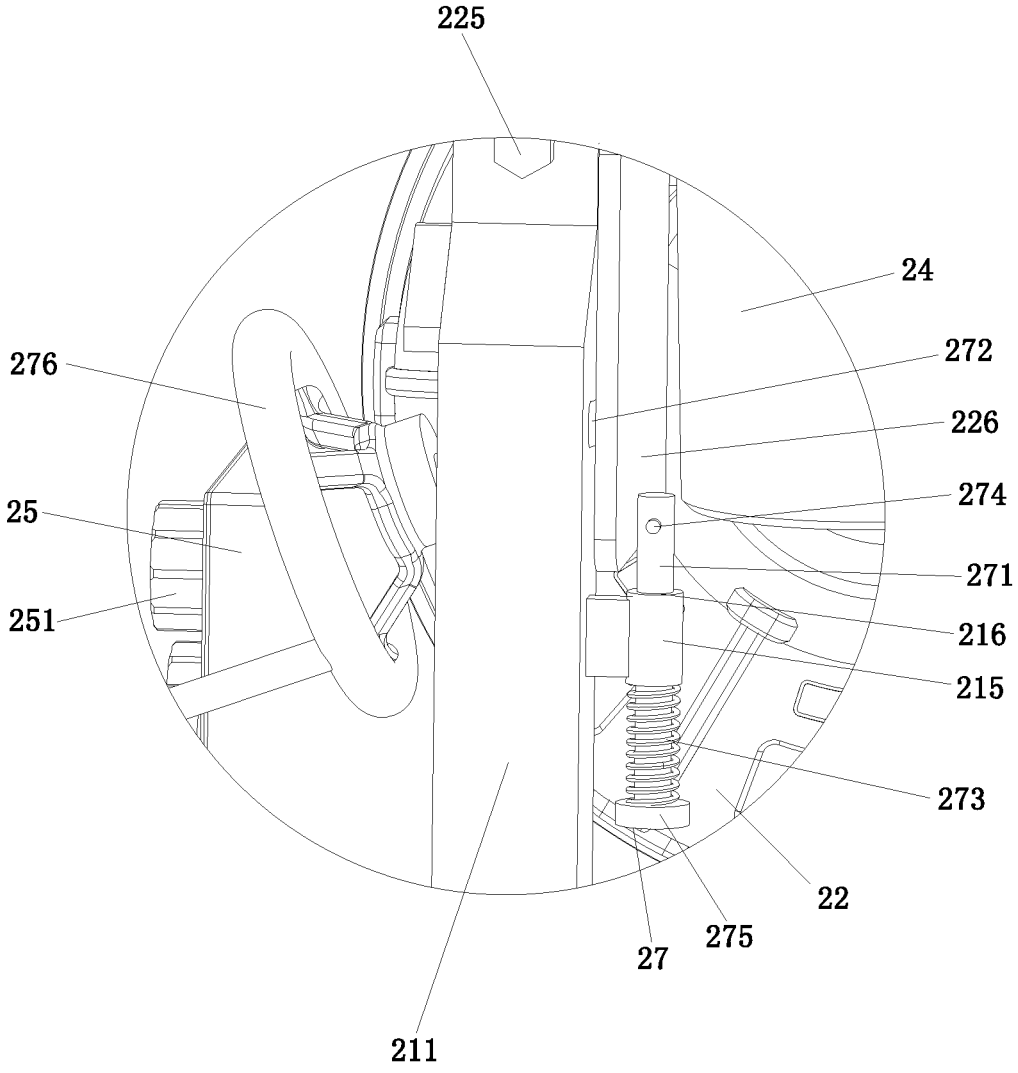
FIG. 3 is a partial enlarged view in accordance with the preferred embodiment of the present invention.
Figure 4:
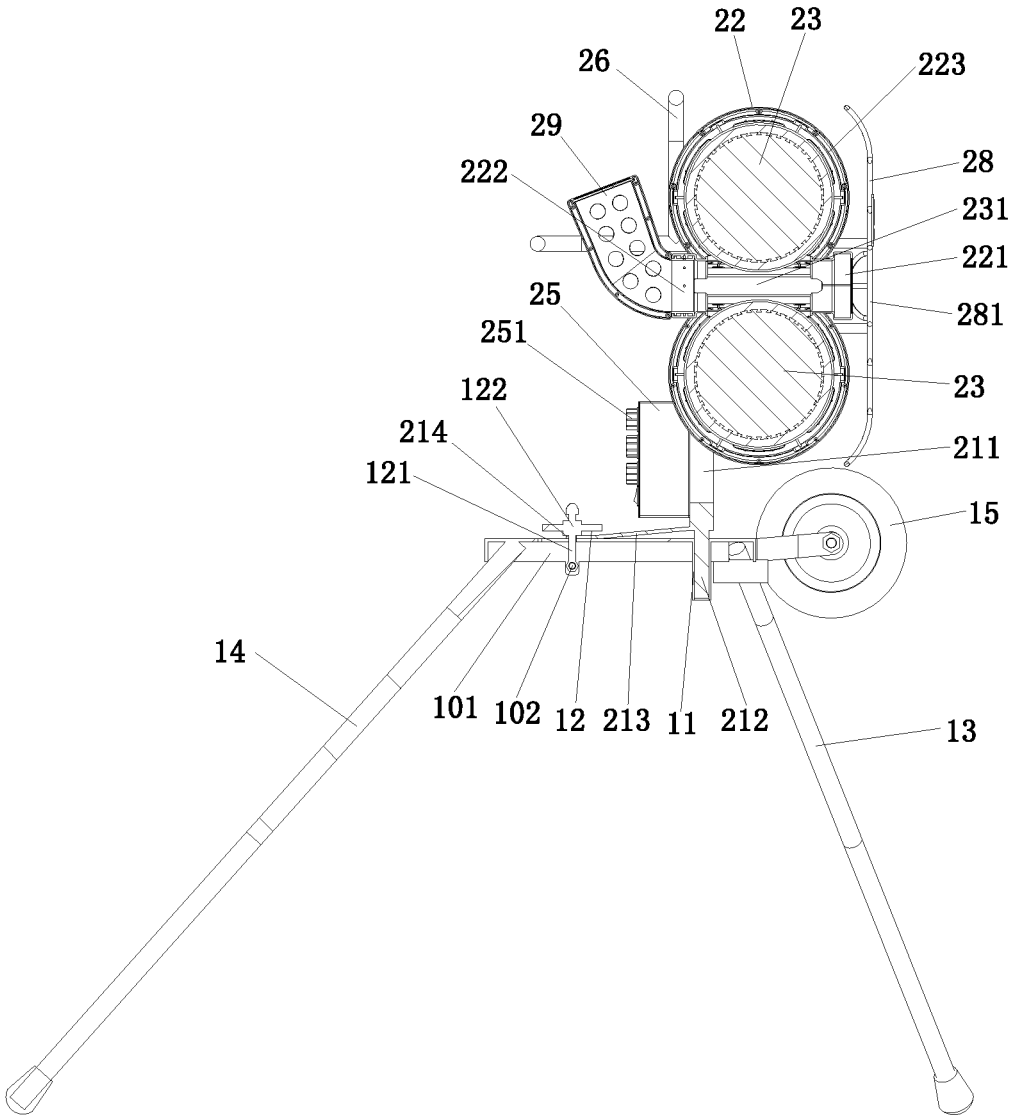
FIG. 4 is a cross-sectional view in accordance with the preferred embodiment of the present invention.

FIG. 1 to FIG. 4 illustrate a specific structure of a preferred embodiment of the present invention.

A four-wheel pitching machine comprises a base 10 and a pitching mechanism 20 on the base 10.

The pitching mechanism 20 includes a frame 21, a housing 22, four rotary wheels 23, four drive units 24, and a control unit 25. The frame 21 is disposed on the base 10. The housing 22 is disposed on the frame 21. The housing 22 is in the shape of a cross. The housing 22 has a ball outlet 221, a ball inlet 222, and a chamber 223. The four rotary wheels 23 are disposed on the upper side, lower side, left side and right side of the chamber 223, respectively. A ball passageway 231 is defined among the four rotary wheels 23. The ball outlet 221 and the ball inlet 222 are located on the front and rear sides of the ball passageway 231. The four drive units 24 are disposed on the housing 22. The four rotary wheels 23 are driven by the four drive units 24, respectively. The control unit 25 is disposed on the frame 21 and located on one side of the housing 22. The control unit 25 has four control knobs 251. The four drive units 24 are respectively connected to the four control knobs 251 of the control unit 25 to adjust the rotational speeds of the four rotary wheels 23, so that the pitching machine is able to throw a breaking ball. A ball holder 29 is provided at the ball inlet 222 of the housing 22. The rotary wheels are disposed inside the housing in a hidden manner, so that the rotary wheels won't be in direct contact with other objects, thereby avoiding injuries when the user comes into contact with the rotary wheels accidentally. The pitching machine has excellent safety performance and improves the stability of the rotary wheels when in use. In particular, the arrangement of four rotary wheels and four drive units makes balls more powerful when the pitching machine pitches balls. The four control knobs control the four rotary wheels to squeeze and rub the ball at different rotational speeds for the pitching mechanism to pitch a breaking ball. The pitching machine can simulate the throw of a ball by a pitcher, thus meeting the practice needs of the practitioners, with good usability and a wide range of applications.

Furthermore, the housing 22 can be rotated forward and backward on the frame 21. The frame 21 has two upright posts 211 extending upwardly. The housing 22 has two mounting portions 224 spaced apart from each other in a left-to-right direction. The two mounting portions 224 are located between the two upright posts 211 and are fixedly connected to the corresponding upright posts 211 via rotating shafts 225, respectively. Preferably, a handle 26 is provided on the housing 22 for the user to control the housing to rotate forward and backward. In this way, the housing can be rotated forward and backward on the frame, allowing the trainer to control the pitching mechanism to pitch balls in multiple directions, thus achieving the training of one machine to many people and improving the practice effect of the practitioner. Besides, the handle is configured for the trainer to control the housing to rotate forward and backward.

Furthermore, the frame 21 can be rotated left and right on the upper end of the base 10. A first rotating part 212 is provided at the lower end of the frame 21. The base 10 has a rotating hole 11 matching the first rotating part. The first rotating part 212 is fitted and positioned in the rotating hole 11.

An operating lever 213 is provided on the frame 21 for the user to control the frame to rotate left and right. The operating lever 213 is located between the frame 21 and the first rotating part 212. A positioning assembly 12 is provided on the base 10. The upper end of the base 10 has a recess 101. The recess 101 is located under the operating lever 213. The positioning assembly 12 is disposed on the recess 101. A second rotating part 102 is provided on the recess 101. The second rotating part 102 extends transversely. The second rotating part 102 can be rotated forward and backward on the recess 101. The positioning assembly 12 includes a positioning rod 121 and a positioning member 122 on the positioning rod 121. The lower end of the positioning rod 121 is located on the second rotating part 102. The rear end of the operating lever 213 has a positioning groove 214. The positioning rod 121 is confined in the positioning groove 214. The positioning member is configured to position the operating lever 213 on the base 10. Thus, the frame can be rotated left and right on the base, so that the trainer can control the pitching mechanism to pitch balls left and right, thereby improving the practice effect of the practitioner. The operating lever is beneficial for the trainer to control and adjust the angle of the frame, further improving the practice effect of the practitioner. The positioning assembly is configured to secure and position the operating lever on the base.

Preferably, an adjustment part 103 is provided on the second rotating part 102 for adjusting the frame to rotate left and right slightly. The second rotating part 102 is movable left and right. The adjustment part 103 is located at one end of the second rotating part 102 and exposed outside the base 10. The second rotating part 102 is controlled by the adjustment part 103 to move left and right for the outer wall of the positioning rod 121 to be in contact with the positioning groove 214 and for the operating lever 213 to control the frame 21 to rotate left and right slightly. In this way, it is easy for the trainer to adjust the frame on the base left and right slightly, without the need for large angle adjustment, thus improving the practice experience of the practitioner.

Furthermore, a locking assembly 27 is provided on the housing 21 for locking the housing. The housing 22 has a locking plate 226 extending downwardly. The locking assembly 27 includes a first locking rod 271, a second locking rod 272, and a spring 273. The front end of the frame 21 has a connecting portion 215. The connecting portion 215 has a through hole 216 passing through the upper and lower ends of the connecting portion 215. The first locking rod 271 is located in the through hole 216. The upper and lower ends of the first locking rod 271 are exposed from the upper and lower ends of the connecting portion 215. The first locking rod 271 is located at the front end of the locking plate 226. A first stop portion 274 and a second stop portion 275 are provided on the upper and lower ends of the first locking rod 271, respectively. The spring 273 is sleeved on the lower section of the first locking rod 271 and is located under the lower end of the connecting portion 215. Two ends of the spring 273 act on the lower end of the connecting portion 215 and the upper end of the second stopper portion 275, respectively. The second locking rod 272 is rotatably disposed on the frame 21. The second locking rod 272 is located at the rear end of the locking plate 226. An operating portion 276 is provided at the rear end of the second locking rod 272.

When locking, the second stop portion 275 is pushed upward to move the first locking rod 271 upward to contact the front end of the locking plate 226, and the spring 273 is in a compressed state. The operating portion 276 is manipulated to move the front end of the second locking rod 272 toward the locking plate 226 and contact the rear end of the locking plate 226 for locking the front and rear ends of the locking plate 226, so as to lock the housing 22.

When unlocking, the operating portion 276 is manipulated to move the front end of the second locking rod 272 away from the locking plate 226, and the first locking rod 271 is returned downward under the action of the spring 273 to disengage from the front end of the locking plate 226, so as to unlock the housing 22. The locking assembly is configured to lock the front and rear ends of the locking plate using the first locking rod and the second locking rod to lock the housing on the frame, so that the product can be stored and moved easily by the trainer or the practitioner.

Preferably, a protective net 2 is provided on the front end of the housing 22. The protective net 28 has an opening 28 corresponding to the ball outlet. The protective net 2 is configured to prevent the ball from hitting the housing directly when the practitioner strikes the ball, thus ensuring the stability of the rotary wheels and the drive unit on the housing when in use. The practicality is strong.

The base 10 includes two first support poles 13, a second support pole 14, and two wheels 15. The two first support poles 13 are detachably connected to the left and right sides of the lower end of the base 10. The second support pole 14 is connected to the rear side of the lower end of the base 10. The second support pole 14 is located behind the two first support poles 13. The wheels 15 are arranged on the left and right sides of the front end of the base 10. The first support poles 13 are located under the wheels 15, respectively. The base 10 has two placement positions 16 for storing the first support poles. The two placement positions 16 are located behind the corresponding first support poles 13, respectively.

When folding, the second support pole 14 is first rotated from back to front to tilt the base 10 forward, and the two wheels 15 are in contact with the ground. Then, the two first support poles 13 are removed and placed on the corresponding placement positions 16, and the second support pole 14 is used to control the movement of the product.

When in use, the first support poles 13 are taken out from the placement positions 16 and then installed on the base 10. Then, the front end of the base 10 is lifted backward from front to back for the first support poles 13 and the second support pole 14 to be in contact with the ground. The two wheels 15 are off the ground and suspended on the front end of the base 10. In this way, the pitching machine can be tilted forward for the wheels to be in contact with the ground, and the first support poles are removed, and then the second support pole is used to move the pitching machine. This is beneficial to fold and store the pitching machine. The placement positions are configured to store the first support poles on the base after the first support poles are removed.

What is claimed is:

1. A four-wheel pitching machine, comprising a base and a pitching mechanism on the base; the pitching mechanism including a frame, a housing, four rotary wheels, four drive units and a control unit, the frame being disposed on the base, the housing being rotatably mounted on the frame for rotation forward and backward with respect to the frame, the housing having a ball outlet, a ball inlet and a chamber, the four rotary wheels being disposed on an upper side, a lower side, a left side and a right side of the chamber respectively, a ball passageway being defined among the four rotary wheels, the ball outlet and the ball inlet being located on front and rear sides of the ball passageway, the four drive units being disposed on the housing, the four rotary wheels being driven by the four drive units respectively, the control unit being disposed on the frame and located on one side of the housing, the control unit having four control knobs, the four drive units being respectively connected to the four control knobs of the control unit to adjust rotational speeds of the four rotary wheels so that the pitching machine is able to throw a breaking ball, the housing having two mounting portions spaced apart in a left-to-right direction and fixed to two upright posts of the frame via rotating shafts, and a locking assembly disposed on the housing and the frame for selectively locking the housing against rotation with respect to the frame, the locking assembly including a locking plate extending downward from the housing, a first locking rod disposed in a through hole of a connecting portion of the frame, the first locking rod having upper and lower ends exposed from upper and lower ends of the connecting portion and having a first stop portion and a second stop portion on the upper and lower ends thereof, a spring sleeved on a lower section of the first locking rod and acting between a lower end of the connecting portion and an upper end of the second stop portion, a second locking rod rotatably disposed on the frame and located at a rear end of the locking plate, and an operating portion at a rear end of the second locking rod for actuating the second locking rod to move into and out of engagement with the locking plate to selectively lock the housing on the frame.

2. The four-wheel pitching machine as claimed in claim 1, wherein the housing is in the shape of a cross.

3. The four-wheel pitching machine as claimed in claim 1, wherein a handle is provided on the housing for a user to control the housing to rotate forward and backward.

4. The four-wheel pitching machine as claimed in claim 1, wherein a protective net is provided on a front end of the housing, and the protective net has an opening corresponding to the ball outlet.

5. The four-wheel pitching machine as claimed in claim 1, wherein the base includes two first support poles, a second support pole and two wheels, the two first support poles are detachably connected to left and right sides of a lower end of the base, the second support pole is connected to a rear side of the lower end of the base, the second support pole is located behind the two first support poles, the wheels are arranged on left and right sides of a front end of the base, the first support poles are located under the wheels respectively, the base has two placement positions for storing the first support poles, and the two placement positions are located behind the corresponding first support poles, respectively.

* * * * *